US007805872B1

(12) United States Patent
Ngan

(10) Patent No.: US 7,805,872 B1
(45) Date of Patent: Oct. 5, 2010

(54) MENU CARD OR DISPLAY MOUNT

(76) Inventor: Chi Lung Ngan, 5 Bradford Rd., Edison, NJ (US) 08820

( * ) Notice: Subject to any disclaimer, the term of this patent is extended or adjusted under 35 U.S.C. 154(b) by 239 days.

(21) Appl. No.: 12/222,398

(22) Filed: Aug. 8, 2008

(51) Int. Cl.
*A47G 1/06* (2006.01)

(52) U.S. Cl. ..... 40/778; 40/360

(58) Field of Classification Search ..... 40/777, 40/778, 359, 360, 607.15, 404, 405
See application file for complete search history.

(56) References Cited

U.S. PATENT DOCUMENTS 605,007 A 5/1898 Odgers
739,315 A * 9/1903 Hutton, Jr. ..... 40/778
1,249,713 A 12/1917 Blyth
2,201,081 A * 5/1940 Culp ..... 40/773
2,517,535 A 8/1950 Cross
2,637,325 A * 5/1953 McCabe ..... 40/537
4,140,565 A 2/1979 Parker et al.
4,244,128 A 1/1981 Russell
5,433,023 A 7/1995 Edwards et al.
6,874,968 B2 4/2005 Schwartz

* cited by examiner

*Primary Examiner*—Joanne Silbermann
(74) *Attorney, Agent, or Firm*—Shlesinger, Arkwright & Garvey LLP

(57) ABSTRACT

A durable, long lasting mount for display information including a backing sheet for the information sheet-card supports and including a binder insert flap for multiple unit sheet-card supports displayed in a binder cover.

14 Claims, 4 Drawing Sheets

MENU CARD OR DISPLAY MOUNT

FIELD OF THE INVENTION

This invention relates to mounts for pictures, cards, menus, or other sheet material display information, and includes stiffening and reinforcing means for maintaining the item displayed which might be in frequent or constant use such as displaying advertising information or menus or the like which are frequently removed from the mount and replaced with subsequent information.

BACKGROUND OF THE INVENTION

Hutton U.S. Pat. No. 739,315 is a typical slit corner mount presently available.

Odgers U.S. Pat. No. 605,007; Blyth U.S. Pat. No. 1,249,713; Cross U.S. Pat. No. 2,517,535; McCabe U.S. Pat. No. 2,637,325; Parker U.S. Pat. No. 4,140,565; Russell U.S. Pat. No. 4,244,128; Edwards U.S. Pat. No. 5,433,023; and Schwartz U.S. Pat. No. 6,874,968 all feature various types of display mounts for photographs and other sheet material.

SUMMARY OF THE INVENTION

It is an object of this invention to provide a mount for sheet-card display information which will withstand frequent handling and use including frequent changing of the information displayed.

Another object of this invention is to provide a sturdy mount which is easily manufactured.

A further object of this invention is to provide a mount for display information which is subject to wear and tear.

Still another object of this invention is to provide a mount which is attractive to customers, particularly where used in restaurants which provide menus which are frequently changed.

Yet a further object of this invention is to provide a mount which can be readily duplicated and placed with a similar mount in back-to-back fashion for display of information both front and back.

Still a further object of this invention is to provide a mount which can be secured in a binder with other similar mounts which will include multiple pictures, menus, or the like.

In summary, this invention relates to mounts for pictures, cards, menus, and other sheet material which can be readily and easily inserted and which will sustain considerable use without materially damaging the mount.

These and other objects of the invention will be apparent from the following description which includes the drawings which are as follows:

DETAILED DESCRIPTION OF THE INVENTION

FIGS. 1 Through 4

Figure 1:
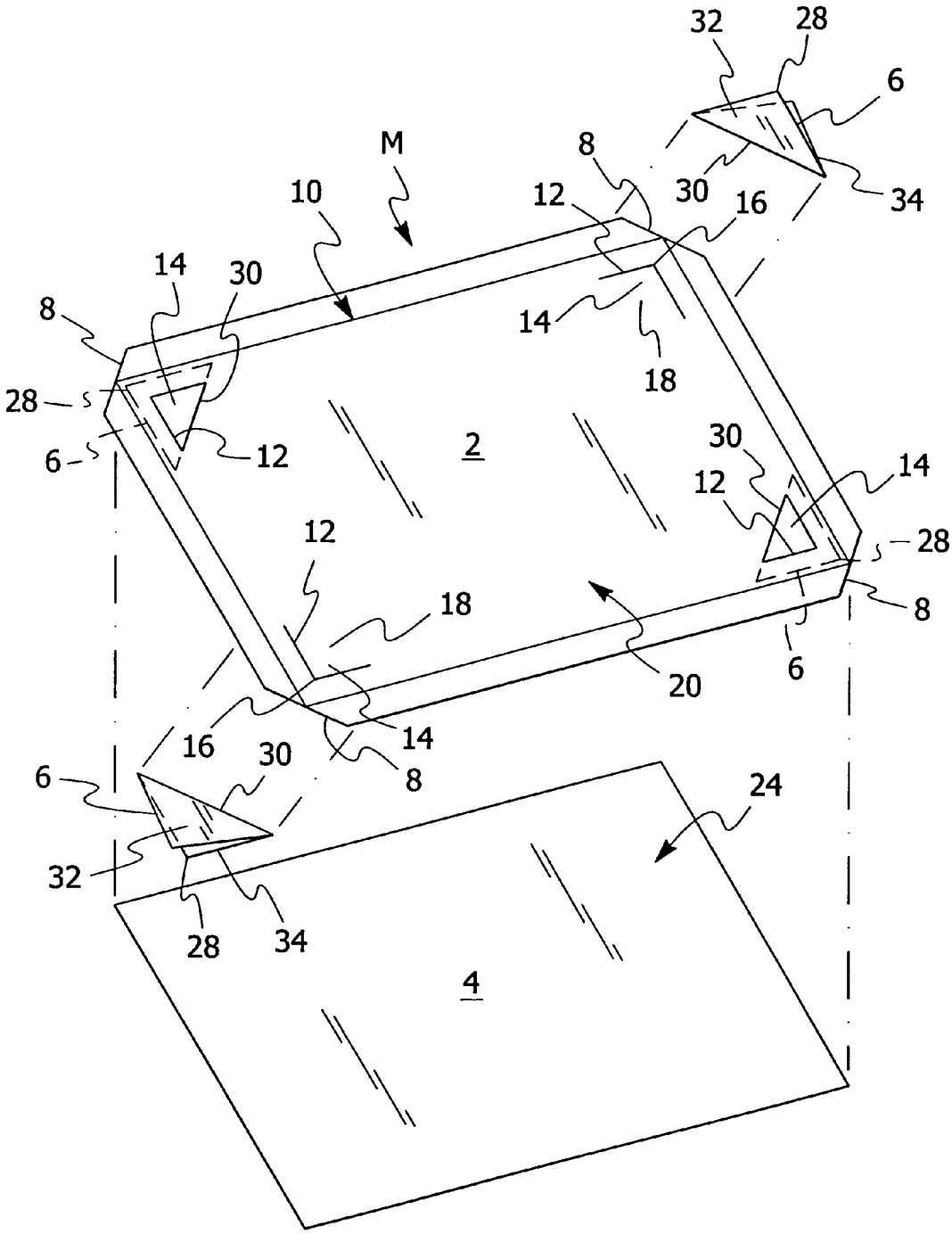
FIG. 1 is an exploded view of the items making up a single mount.
Figure 2:
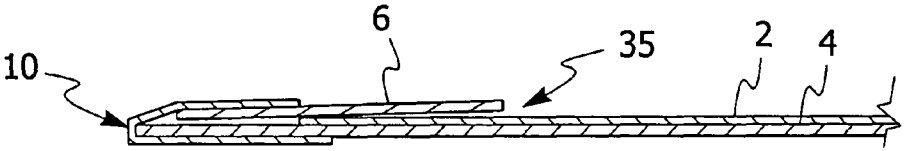
FIG. 2 is an enlarged cross-sectional view taken along the line 2-2 of FIG. 3.

As best shown in FIGS. 1 through 4, the mount M includes an information sheet-card support 2, a backing sheet 4, and lock tabs 6. The information sheet-card support 2 is of pliable, flexible sheet material which may be of paper stock, plastic, metal foil, or the like. As shown, the information sheet-card support 2 is of generally rectangular configuration with mitered corners 8. The information sheet-card support 2 has a peripheral marginal border 10. Spaced from the marginal border 10 are corner slits 12, which form a tongue 14. Each tongue 14 has an apex 16 and a base 18. It will be obvious that the tongues 14 are spaced away from the peripheral marginal border 10. Although it is preferred that the corners 8 be mitered, they may come to a point which, as subsequently noted, makes folding inwardly of the peripheral marginal border 10 more difficult.

Figure 3:
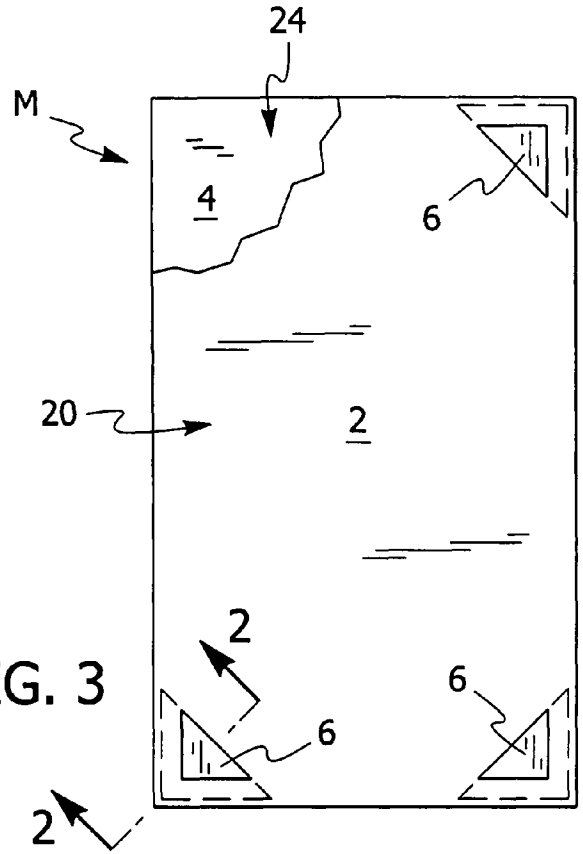
FIG. 3 is a top plan view of the mount with a portion shown broken away to show the slit and portions shown in phantom lines.
Figure 4:
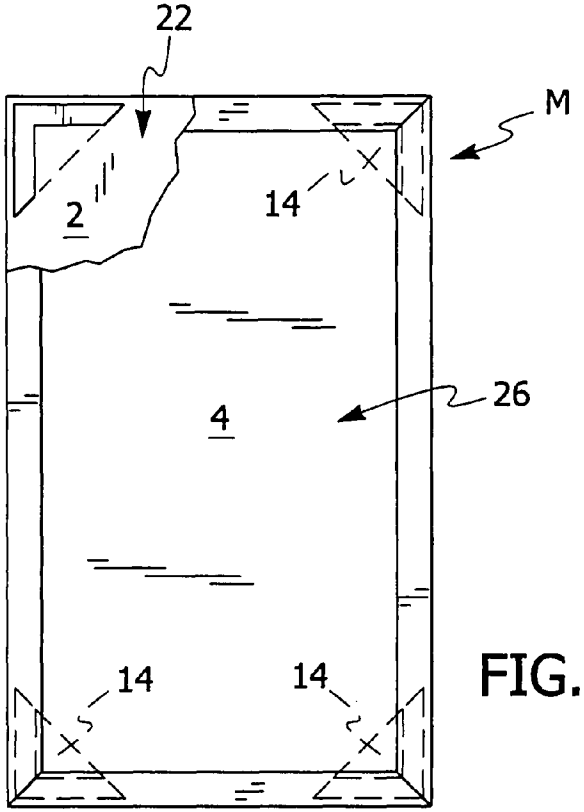
FIG. 4 is a bottom plan view of the mount with portions shown in phantom lines.

As best noted in FIGS. 3 and 4, the information sheet-card support 2 has a front 20 shown in FIG. 1 and FIG. 3 and a back 22 shown in FIG. 4. The backing sheet 4 has a front 24 shown in FIGS. 1 and 3 and a back 26 shown in FIG. 4. It is to be noted that the information sheet-card support 2 is of a greater planar dimension than the backing sheet 4 while the backing sheet 4 is substantially thicker than the information sheet-card support.

The lock tabs 6, as illustrated, are of triangular configuration having an apex 28 and a base 30 as best illustrated in FIG. 1. It is to be noted that the base 18 of the tongue 14 is shorter than the base 30 of the lock tab 6. Thus, when the lock tabs 6 are inserted into the corner slots 12, a portion of the front surface of the lock tabs 6 engages the back 22 of the information sheet-card support 20, while a portion of the back surface 34 of the lock tab 6 abuts the tongue 14 and the back surface 22 of the information sheet-card support 2. This arrangement leaves a slot for positioning a corner of the item to be displayed, such as a menu, card, picture, or the like.

When the information sheet-card support 2 is assembled with the lock tabs 6 and the backing sheet 4, the peripheral marginal border 10 is folded down and around the backing sheet 4 and secured to the back 26 of the backing sheet 4 by adhesive or other means. This arrangement provides a firm grip for the displayed item D and avoids damage from frequent interchange of items D.

FIGS. 5 Through 8

Figure 5:
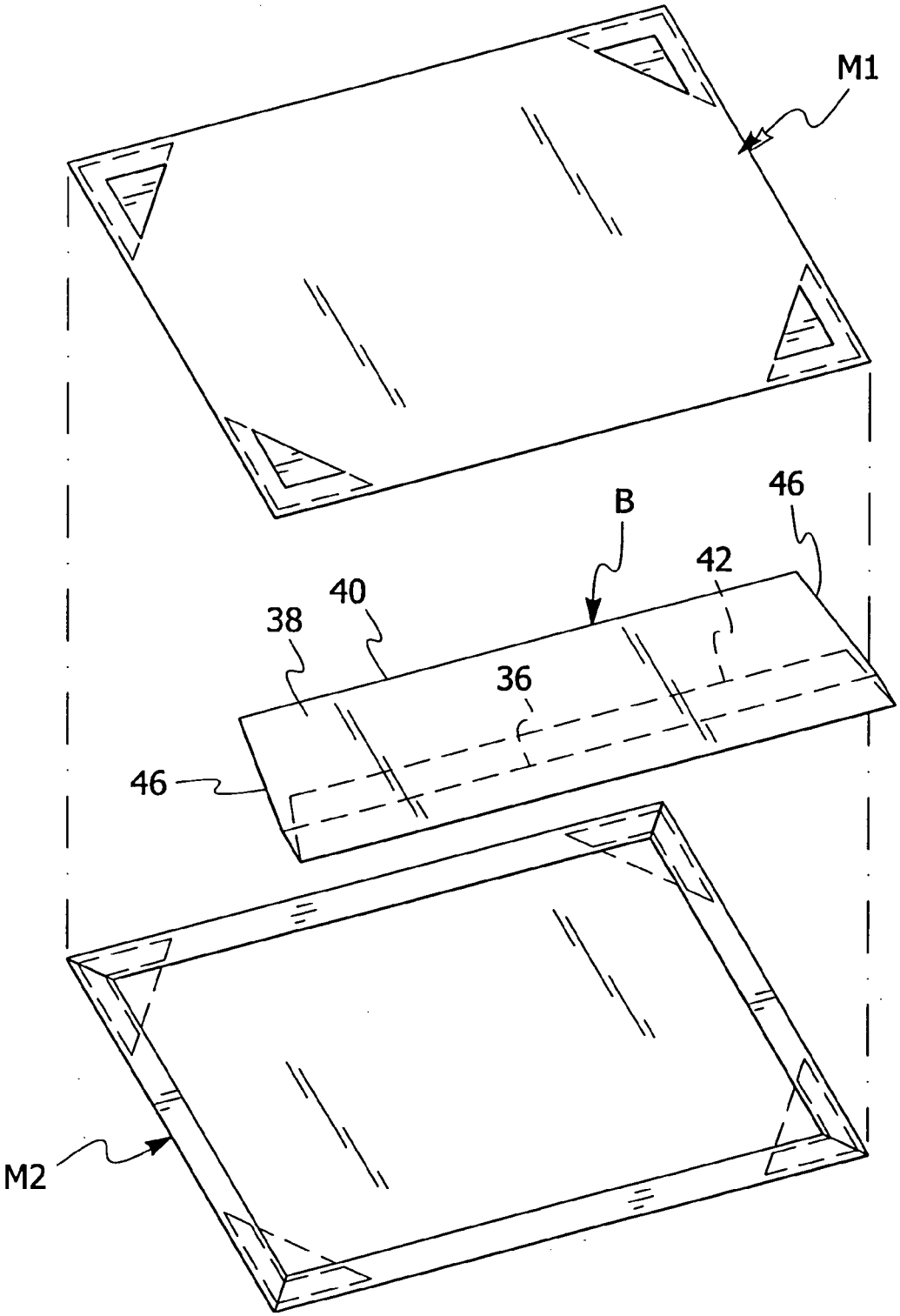
FIG. 5 is an exploded view of a modified form of the invention showing back-to-back mounts and an inserted binder insert flap.
Figure 7:
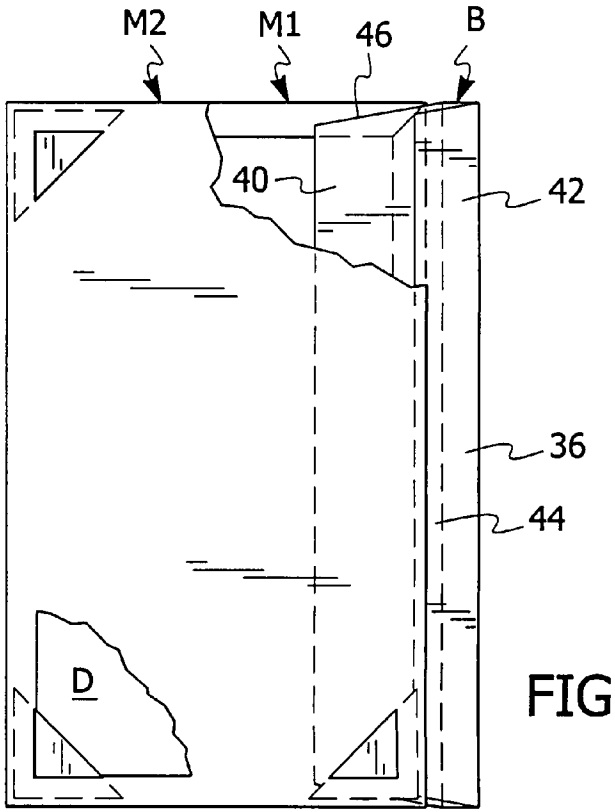
FIG. 7 is a bottom plan view of the mount with the binder flap inserted and a portion broken away and including portions shown in phantom lines.
Figure 6:
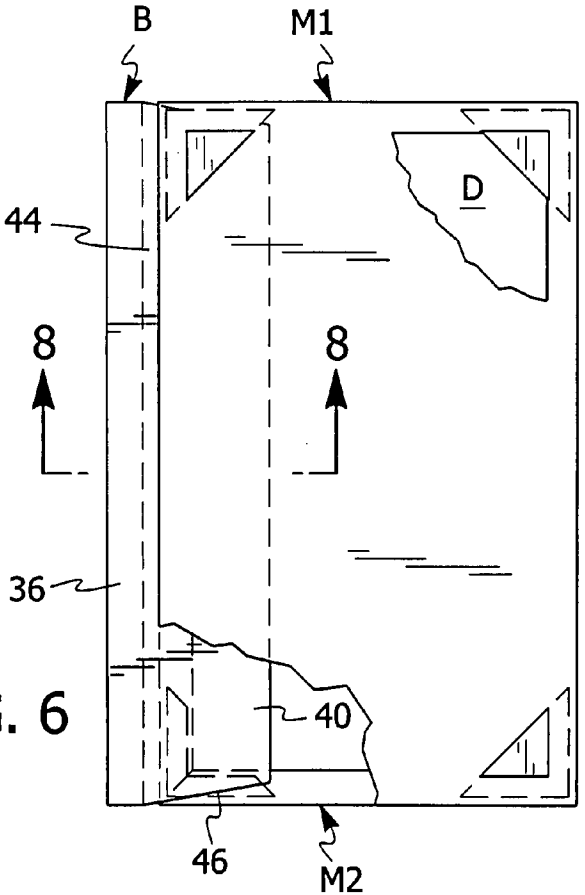
FIG. 6 is a top plan view of the mount with inserted binder flap and including a portion broken away and certain portions in phantom lines.
Figure 8:
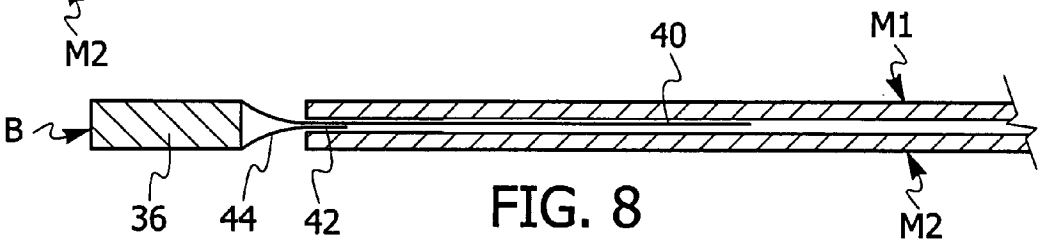
FIG. 8 is an enlarged cross-sectional view taken along the lines 8-8 in FIG. 6.

In the exploded view of FIG. 5, the upper mount M1 and the lower mount M2 are identical to the mount M illustrated in FIGS. 1 through 4.

The mounts M1 and M2 are positioned in back-to-back relationship. A binder insert flap B is positioned between the mounts M1 and M2. The binder insert flap B includes a stiffener 36 which runs the length of the mounts M1 and M2. A wrapper 38 covers the stiffener 36 and has a long end 40 and a short end 42. The ends 40 and 42 are positioned between the upper and lower mounts M1 and M2. The mounts M1 and M2 and the binder insert flap B are secured together by adhesive or other means. A gap is left between the stiffener 36 and the mounts M1 and M2 which provides a hinge 44. This permits the binder insert flap B, which would be inserted into a binder cover (not shown). The binder cover could be a spiral type which spiral interconnects with the binder B, or the binder insert flap B could be punched for a three-hole or two-hole binder cover or the like. Other securement means could be made for clamping in a binder cover. This would permit a plurality of mounts M to be positioned in the binder cover.

As you will note, the flap B has a short end 40 with its sides 46 beveled to eliminate a bulge when the mounts M1 and M2 are secured together.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention.

What is claimed is:

1. A first mount for sheet-card display information comprising:

a) an information sheet-card support having front and back surfaces;

b) said information sheet-card support having corners and a peripheral marginal border having outer and inner edges;

c) said information sheet-card support having corner slits having edges spaced inwardly from said peripheral marginal boarder;

d) said corner slits each forming in said information sheet-card support a tongue having front and back surfaces and a base and an apex;

e) an information sheet-card support lock tab inserted into each of said corner slits;

f) said lock tabs each having front and back surfaces and a base and an apex;

g) said lock tabs each having a substantial portion of said back surface abutting said tongue front surface and a portion of said lock tab front surface abutting said information sheet-card support back surface;

h) each of said lock tabs base extending beyond the edges of its respective corner slit;

i) a backing sheet for said information sheet-card support having a peripheral edge circumscribing said peripheral marginal border inner edge and having front and back surfaces;

j) said peripheral marginal boarder of said information sheet-card support extending over and around said backing sheet peripheral edge and secured to said backing sheet back surface; and h) said backing sheet front surface bring secured to said information sheet-card support back surface and said lock tabs back surface.

2. A first mount as in claim 1 and wherein:

a) said information sheet-card support has mitered edges.

3. A first mount as in claim 1 and wherein:

a) said information sheet-card support and said backing sheet are rectangular.

4. A first mount as in claim 1 and wherein:

a) said backing sheet is substantially thicker than said information sheet-card support.

5. A first mount as in claim 1 and wherein:

a) said lock tabs are triangular.

6. A mount as in claim 1 and including:

a) a second mount similar said first mount and secured to said first mount in back-to-back relation.

7. A first mount as in claim 6 and including:

a) a binder insert flap connected to said first and second mounts.

8. A first mount as in claim 7 and wherein:

a) said binder insert flap is secured between said first and second mounts.

9. A first mount as in claim 1 and wherein a) said backing sheet is more thicker than said information sheet-card support.

10. A mount as in claim 7 and wherein:

a) said binder insert flap includes a hinge.

11. A first mount as in claim 10 and wherein:

a) said binder insert flap includes a stiffener.

12. A first mount as in claim 11 and wherein:

a) said binder insert flap includes a wrapper around said stiffener and extending between said first and second mounts.

13. A first mount as in claim 12 and wherein:

a) said wrapper includes long and short ends extending between said first and second mounts.

14. A first mount as in claim 13 and wherein:

a) the short end of said flap has beveled sides.

* * * * *